United States Patent [19]

Wyatt, Jr. et al.

[11] 4,057,936

[45] Nov. 15, 1977

[54] THERMALLY INSULATED WINDOW SYSTEM

[75] Inventors: William Burk Wyatt, Jr., Nashville, Tenn.; Bruce D. Benefield, Huntsville, Ala.

[73] Assignee: Videre Corporation, Nashville, Tenn.

[21] Appl. No.: 776,609

[22] Filed: Mar. 11, 1977

Related U.S. Application Data

[63] Continuation-in-part of Ser. No. 765,280, Feb. 3, 1977.

[51] Int. Cl.[2] ..... E05B 65/04

[52] U.S. Cl. ..... 49/61; 49/91; 49/142; 49/168; 49/DIG. 1; 52/618; 52/731; 98/88 L

[58] Field of Search ..... 49/64, 63, 67, 61, 381, 49/DIG. 1, 91, 142, 168, 171, 371, 400, 504; 52/618, 731, 732; 98/88 L

[56] References Cited

U.S. PATENT DOCUMENTS

| | | | |
|---|---|---|---|
| 2,152,566 | 3/1939 | Phillips | 98/88 L |
| 2,305,445 | 12/1942 | Poor et al. | 98/88 L |
| 2,612,097 | 9/1952 | Pollman | 49/61 X |
| 2,637,265 | 5/1953 | Emmert | 98/88 L |
| 2,904,854 | 9/1959 | Adamson | 49/64 X |
| 3,020,951 | 2/1962 | Graulich | 49/63 X |
| 3,047,914 | 8/1962 | Kahn et al. | 49/91 X |

FOREIGN PATENT DOCUMENTS

| | | | |
|---|---|---|---|
| 653,664 | 9/1964 | Belgium | 49/DIG. 1 |

*Primary Examiner*—Philip C. Kannan
*Attorney, Agent, or Firm*—Parmelee, Miller, Welsh & Kratz

[57] ABSTRACT

A thermally insulated window system for use in windows and doors which provides a thermally insulated frame and means for completely insulating the area of the frame. Novel panel sections are used to form the frame, as well as vents for a portion of the frame, and shutters which completely cover the area of a double panel window section. The novel panels contain a thermal break and a structurally sound construction filled and monolithically sealed with closed-cell foamed polymeric material.

6 Claims, 9 Drawing Figures

THERMALLY INSULATED WINDOW SYSTEM

CROSS-REFERENCE TO RELATED APPLICATIONS

This application is a continuation-in-part of an earlier application of one of the inventors herein, William Burk Wyatt, Jr., Ser. No. 765,280 filed Feb. 3, 1977 and entitled "Insulated Window Unit."

BACKGROUND OF THE INVENTION

The present energy shortage which has become more severe as time progresses has impressed upon the populace the need to conserve any energy that may be so conserved. One substantial area of conservation exists in homes and buildings where insulated members are used to prevent loss of heat to the atmosphere.

Windows and doors have been two of the chief sources of heat loss in buildings and, even with the use of insulated windows, storm windows and storm doors, additional measures are critically needed to further conserve energy. Even when double-panel glass windows are used, significant heat loss results through the thermal inefficiency of existing insulated windows and also through the frames of the windows.

We have developed a novel window system for use in windows and doors which provides for complete thermal insulation of the complete window area and which is produced such that thermally insulated, structurally sound panel members are used that have a novel thermal break therein. By using the present panel construction, substantial material savings are incurred without sacrificing the strength while enhancing the thermal properties of the panels.

SUMMARY OF THE INVENTION

An insulated window system is completely sealable by insulated panel members and comprises specially constructed panel members. An insulated frame is provided with insulated sealable vents to cover a portion of the frame while a double-pane window is situate in another portion of the frame. Insulated shutters are provided on the inside of the window system to completely cover the windowpane area of the window system when so desired. The various components of the window system are comprised of panel members which contain a pair of spaced channel members with inward flanges, and a rigid plastic sheet of serrated cross-section within the channels having means thereon to contact the flanges of the channels and seal the spacing therebetween to provide a closed shell with an efficient thermal break.

DETAILED DESCRIPTION OF THE PREFERRED EMBODIMENT

Figure 1:
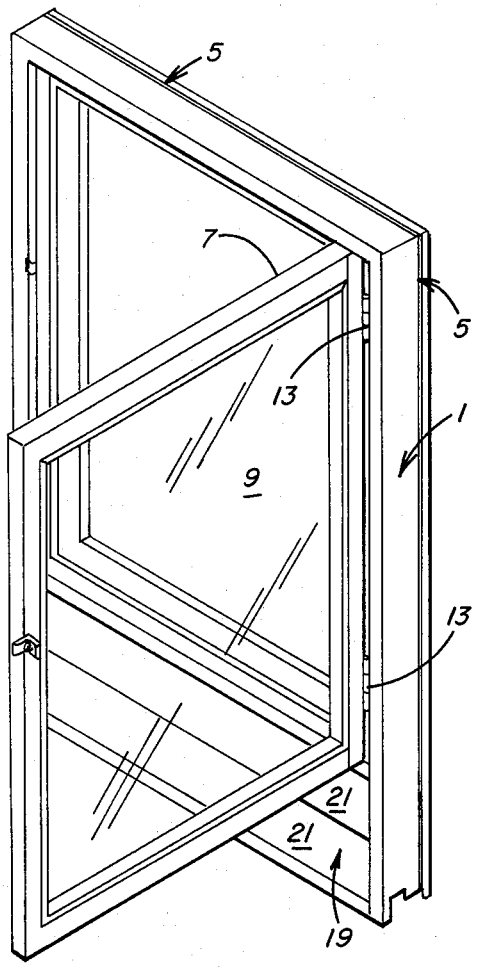
FIG. 1 is an isometric view of the insulated window system of the present invention, with shutters removed, viewed from the inside with the window in open position and the vents in closed position.
Figure 2:
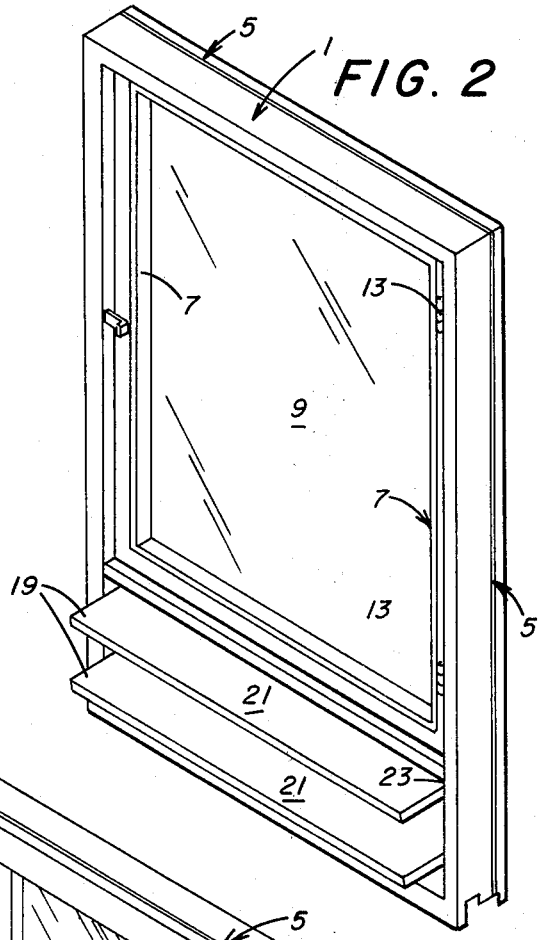
FIG. 2 is a view similar to that of FIG. 1 with the vents in open position and the window in closed position.
Figure 3:
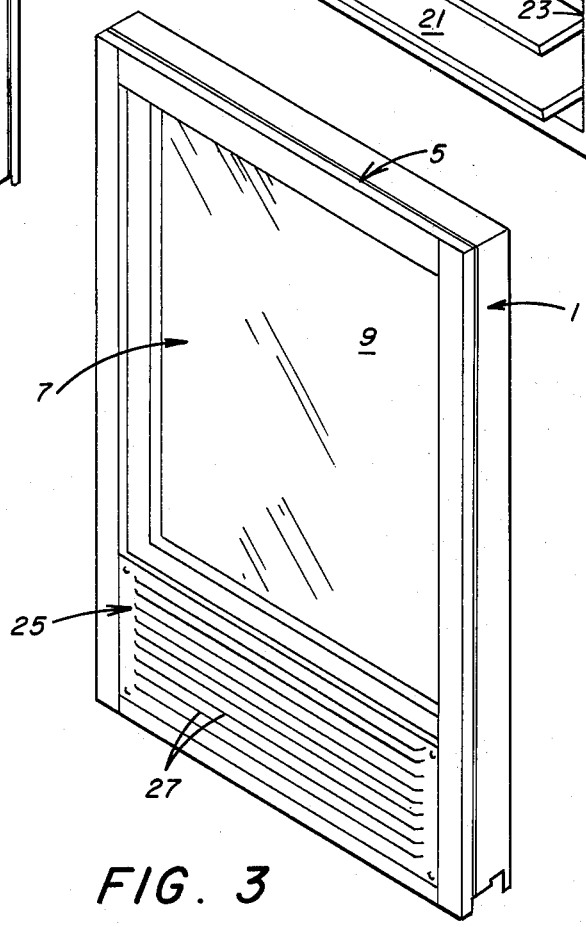
FIG. 3 is an isometric view of the window system of the present invention viewed from the outside with the window in closed position.

The improved insulated window system is schematically illustrated in FIGS. 1–3 which illustrate the system in the form of a replacement unit which may be used to replace an existing window. This system is similar to the window unit described in co-pending application of William Burk Wyatt, Jr. filed Feb. 3, 1977 as Ser. No. 765,280, the contents of which are hereby incorporated herein.

This improved unit comprises a frame 1 which is of hollow construction and which is filled with a foamed-in-place and expanded closed-cell polymeric foam material 57 and has a novel thermal break 5 as hereinafter described. A first portion of the frame 1 contains a window unit 7 comprising spaced panes of glass 9 separated by an air space 11 for insulating purposes. The window unit 7 containing the spaced panes of glass also has a thermal break 5, to provide a sealed, insulated unit tightly mounted into the frame 1.

Figure 8:
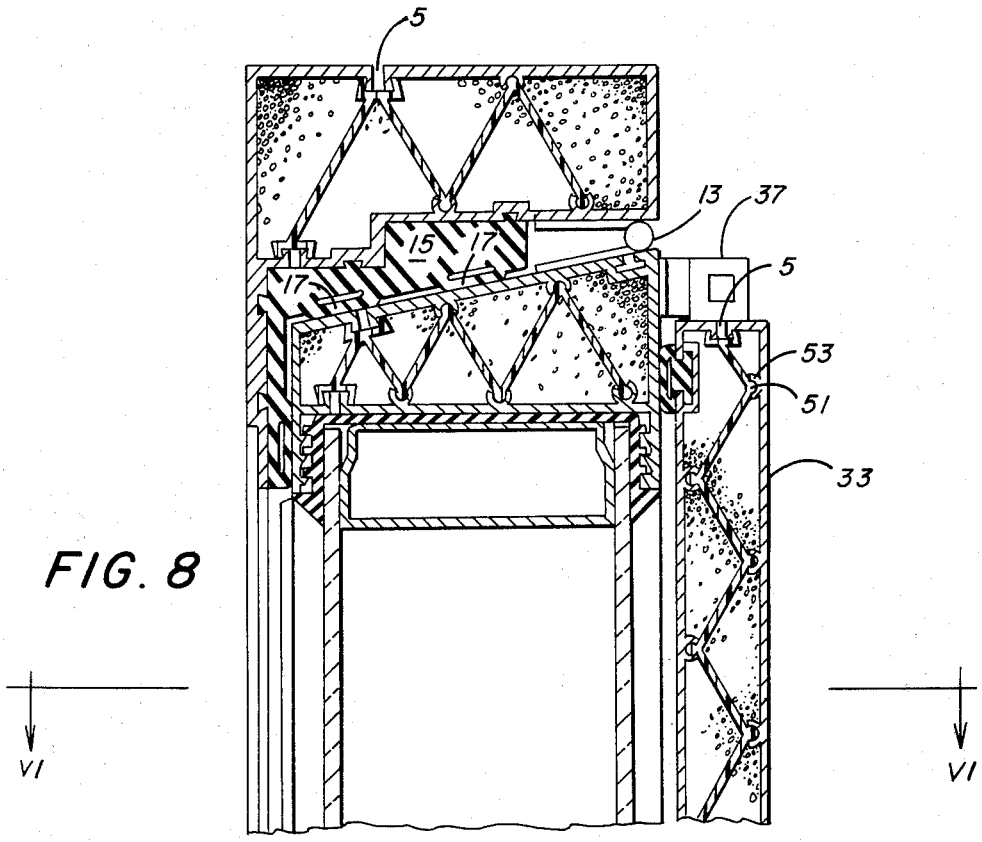
FIG. 8 is a plan view in section of one side of the insulated frame showing the shutters and window in closed position.
Figure 9:
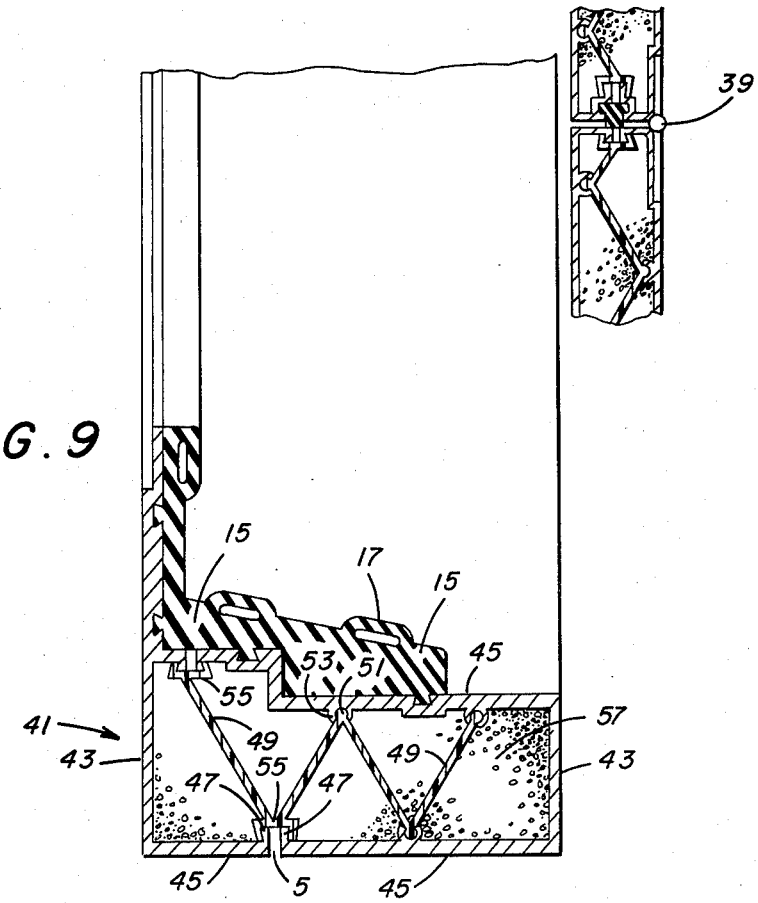
FIG. 9 is a plan view in section of one side of the insulated frame of the present invention with the window in open position.

As illustrated in FIG. 1, the window is hingedly secured to the unit by hinges 13 to permit the dual pane window to be opened to allow for cleaning thereof. Sealing means 15 are provided (FIG. 8) with compressible segments 17. When the inner window is closed, as illustrated in FIG. 8, the compressible segments 17 of the seal 15 are compressed and create an airtight seal between the window and the frame 1.

In a second portion of the frame 1, there is provided a vent 19 which has insulated vanes 21 mounted on pivots 23. The vent 19 is shown positioned below the window unit 7, although the particular placement of the vent with relation to the window unit in the frame 1 may be varied depending upon the needs of the user. The insulated vanes 21 are also of double-walled construction filled with an expanded closed-cell polymeric foam material 57 and contain the thermal break 5. Seals 25 are provided on the ends of the vanes such that, when closed, the vanes 21 are tightly sealed against the passage of air. When the vanes 21 are in open position, as shown in phantom in FIG. 7, air is permitted to flow therethrough. On the outside of the window system there is provided a slotted member 25 having downwardly directed slats 27 to permit air passage while preventing precipitation or large objects from passing through the vent, such as an intruder's hand. If desired, a filter 29, of fiberglass or other filtering material, may be provided between the slotted member 25 and the vanes 21 so as to filter insects and other airborne material from any air passing between the vanes 21.

With the exception of the novel thermal break employed in the present invention, the above-described components are disclosed in the above-identified co-pending application. In the present construction the novel thermal break and additional thermally significant components are added, such as the shutters, which are constructed as follows.

Figure 4:
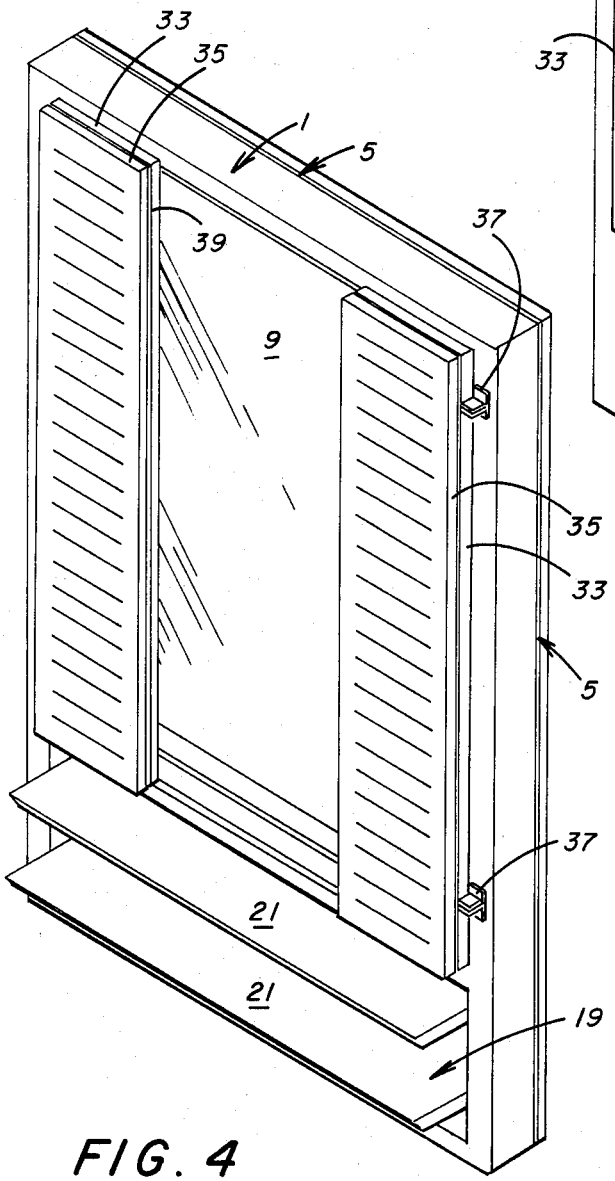
FIG. 4 is an isometric view of the window with shutters attached and in open position and the vents also in open position.
Figure 5:
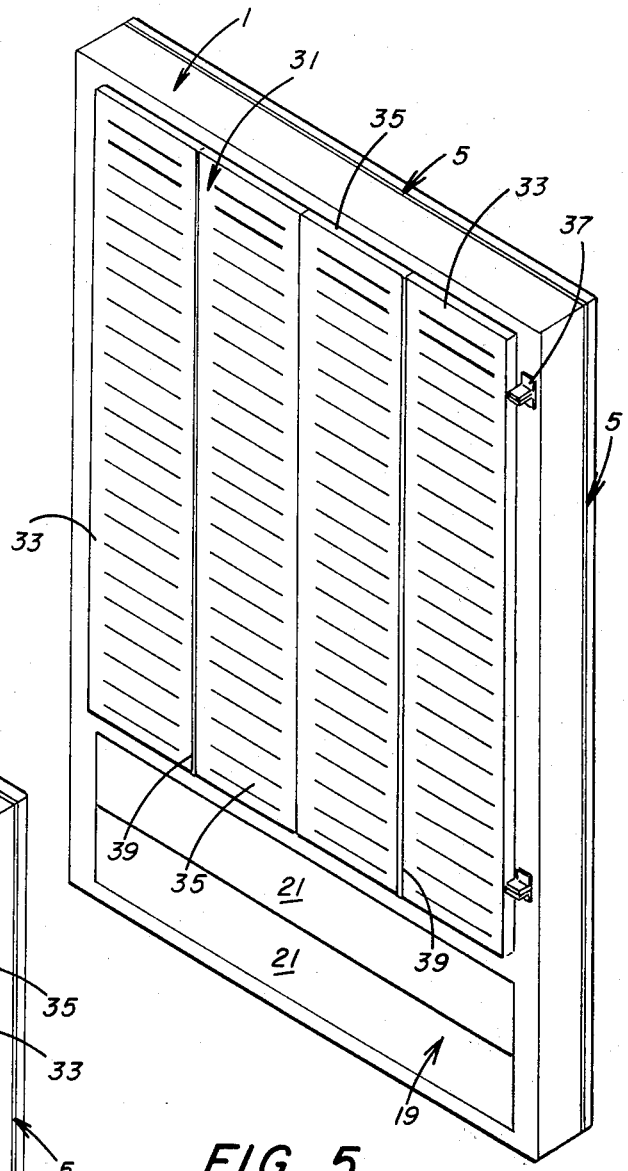
FIG. 5 is a view similar to FIG. 4 with the shutters in closed position and the vents in closed position to provide a completely thermally protected unitized window system.

As illustrated in FIGS. 4 and 5, shutter means 31 are provided on the window system to further insulate the system. While the term "window system" is used throughout the following specification, such term is meant to include doors and storm doors or the like constructions which use a section of glass area in conjunction with a section of vent area. This shutter means is illustrated as a pair of foldable shutter segments 33 and 35 which are hingedly affixed to the frame 1 on the inner portion thereof to close off the windowpane areas of the window system. This shutter means comprises foldable portions 33 and 35 attached to the frame 1 by hinges 37 and the segments 33 and 35 foldably or hingedly attached to each other at 39 so as to enable partial or full closure of the windowpane area. The shutter segments 33 and 35 may also be filled with a foamed-in-place and expanded closed-cell polymeric foam material 57 to provide insulation. With the shutter segments 33 and 35 in extended positions, as illustrated in FIG. 5, the entire window system is completely sealed to provide a completely insulated area of window space. Thus, when light is not required in a room where such a window system is provided, or when insulating needs prevail over natural light needs, the shutters may be extended to close the windowpane area to completely seal and insulate the area enclosed by the frame 1. Even when light is desired, the shutters, when in folded positions, while light will pass through the panes, will cover the side portions of the windowpane area to add insulative properties to the window system. Since the sides of windows are often covered by draperies or the like, the light which will pass through the window system should not be seriously affected by the presence of the insulative shutters.

The present invention incorporates a novel thermal break and panel design which provides exceptional thermal insulating properties as well as excellent structural stability. The panel design itself is disclosed in our co-pending application entitled "Thermally Insulated Panel" filed on even date herewith, the contents of which are hereby incorporated by reference.

Figure 6:
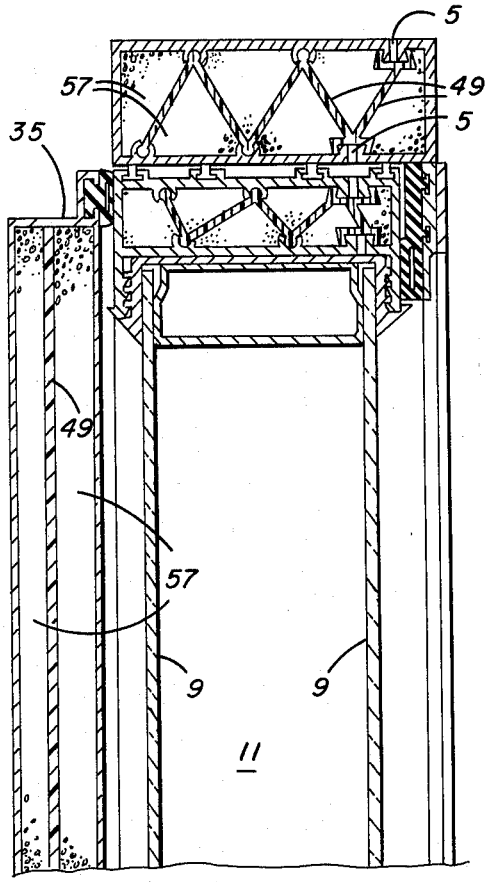
FIG. 6 is a side elevational view in section of the upper portion of the insulated frame and window of the present invention and would seat on FIG. 7.
Figure 7:
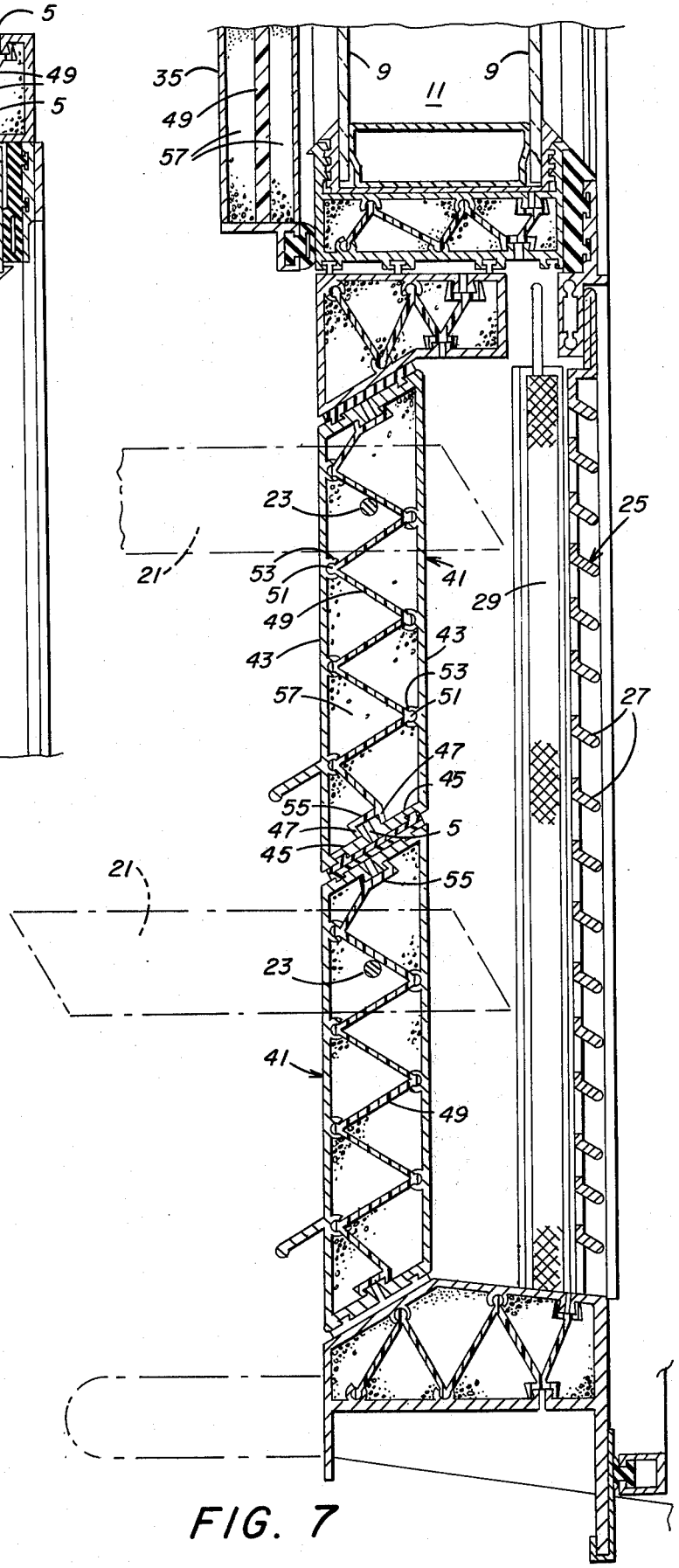
FIG. 7 is a side elevational view in section of the lower portion of the insulated frame of the present window system, showing the lower portion of the window and closed vent, with the vanes also shown in phantom in an open position, which view would mate with FIG. 6.

The panel design with thermal break 5 is best illustrated in FIGS. 6, 7 and 8 wherein the frame 1 for the window and other panel members, such as the vanes 21 and optionally the shutter segments 33 and 35, are constructed in a novel configuration to provide exceptional thermally insulative as well as structural properties.

The hollow panel-shaped sections which comprise the frame 1, vanes 21 and shutter segments 33 and 35 comprise, as illustrated, a pair of channel-shaped members 41 having a base 43 and sidewalls 45, the wall sections having inwardly directed flanges 47 extending along both sides thereof, with the open portion of the channels facing each other. A rigid plastic sheet 49 of serrated cross-section is situate between the opposed channels 41 with portions of the sheet contacting the inner surface of each of the channels. The rigid plastic sheet 49 has means thereon to contact the flanges 47 of both sides of channels 41 to seal the spacing therebetween and with the separation of the channels forms a thermal break 5 while providing a closed shell for the panel-shaped section.

Provided on the serrations of the rigid plastic sheet 49 are means to lock the sheet in place between the channel members, such as raised bosses 51, which means cooperate with grooved extensions 53 on the inner surfaces of the channels. The means for contacting the flanges 47 of opposed channels are illustrated as a generally U-shaped member 55 which contacts and encloses both channel flanges to provide a sealed shell for the panel section and the thermal break.

A closed-cell polymeric foam material 57, such as foamed-in-place, low-density (1.5–4.0 pounds per cubic foot) polyurethane, completely fills the void between the inner surfaces of the channels 41 and the rigid plastic sheet 49 and forms a monolithic seal therebetween.

There has been provided, according to the present invention, a completely thermally insulated window system, for use in windows or doors, which provides complete insulation for a window or door area and which is formed from thermal-break panel sections having exceptional thermal and structural properties.

We claim:

1. An insulated window system, for use in windows or doors, completely sealable by insulated panel members comprising:

an insulated frame section comprising a plurality of thermal break panel members, each panel member comprising a pair of spaced channel-shaped sections having inwardly extending flanges along both sides thereof, facing each other, a rigid plastic sheet of serrated cross-section situate between said channels and contacting the inner surface of each of said channels, said plastic sheet having means thereon to contact the flanges of both of said channels to bind the channels together and seal the spacing therebetween to provide a closed shell, and foamed-in-place, expanded, closed-cell foamed polymeric material filling and monolithically sealing said shell to form the panel member; a double-pane window mounted within a first portion of the insulated frame section;

shutter sections attached adjacent the inner surface of the double-pane window movable from a first position completely covering the windowpanes to a second position exposing at least a portion of the windowpanes; and sealable vent means mounted in a second portion of the insulated frame section such that the window and vent occupy the area of said insulated frame section.

2. An insulated window system as defined in claim 1 wherein said shutter sections comprise a plurality of foldable segments foldable from said first to said second position.

3. An insulated window system as defined in claim 1 wherein said channel-shaped sections are formed from aluminum.

4. An insulated window system as defined in claim 3 wherein said closed-cell foamed polymeric material is polyurethane and said rigid plastic sheet is polystyrene.

5. An insulated window system as defined in claim 1 wherein said vent means are constructed from thermal break panel members as are used to form said insulated frame sections.

6. An insulated window system as defined in claim 1 wherein said shutter sections are constructed from thermal break panel members as are used to form said insulated frame sections.

* * * * *